US005775222A

United States Patent [19]

Zweifel et al.

[11] Patent Number: 5,775,222

[45] Date of Patent: Jul. 7, 1998

[54] INDIVIDUALLY DRIVEN FOLDER FOR A ROTARY PRINTING PRESS

[75] Inventors: Johann Zweifel, Boll; Thomas Treuthardt, Wohlen, both of Switzerland

[73] Assignee: Maschinenfabrik WIFAG, Bern, Switzerland

[21] Appl. No.: 647,467

[22] Filed: May 3, 1996

[30] Foreign Application Priority Data

May 4, 1995 [DE] Germany ..... 195 16 443.1

[51] Int. Cl.[6] ..... B41F 13/56; B41F 13/58

[52] U.S. Cl. ..... 101/227; 270/6; 270/8

[58] Field of Search ..... 101/228, 227, 101/226; 270/4, 6, 20.1, 21.1, 8, 43, 52.09; 493/359, 431, 369, 425, 424, 477, 478

[56] References Cited

U.S. PATENT DOCUMENTS

| | | | |
|---|---|---|---|
| 3,608,889 | 9/1971 | Woessner et al. | 270/6 |
| 3,897,727 | 8/1975 | Fulk | 101/227 |
| 4,050,686 | 9/1977 | McCain et al. | 270/52.09 |
| 4,279,410 | 7/1981 | Bolza-Schünemann | 270/6 |
| 4,564,470 | 1/1986 | Schmitt | 270/21.1 |
| 4,895,356 | 1/1990 | Rudolf | 270/21.1 |
| 5,039,076 | 8/1991 | Fischer | 270/47 |
| 5,405,126 | 4/1995 | Mack | 270/6 |
| 5,439,206 | 8/1995 | Raasch et al. | 270/8 |
| 5,520,378 | 5/1996 | Kepert | 270/8 |
| 5,522,586 | 6/1996 | Bennett et al. | 270/8 |
| 5,573,231 | 11/1996 | Stab | 270/43 |

*Primary Examiner*—Eugene H. Eickholt
*Attorney, Agent, or Firm*—McGlew and Tuttle

[57] ABSTRACT

A rotary printing press comprising a plurality of folder units including a cutting cylinder and a folding jaw cylinder with each of the folder units having a separate drive motor mechanially driving each folder unit separately from the plurality of printing units with each folder unit registerable independently from the plurality of printing units.

18 Claims, 6 Drawing Sheets

INDIVIDUALLY DRIVEN FOLDER FOR A ROTARY PRINTING PRESS

FIELD OF THE INVENTION

The present invention pertains to a rotary printing press with a folder unit including a drive motor for individually driving a cutting cylinder and a folding jaw cylinder.

BACKGROUND OF THE INVENTION

A folder is, or many folders are, driven and synchronized by a main drive via a longitudinal shaft in prior-art rotary printing presses.

One example of a prior-art drive, e.g., one according to DE 41 27 321 A1, is schematically shown longitudinal shaft 1.10 is coupled here mechanically with the folder, comprising a cutting cylinder 2, a collecting cylinder 3, and a folding jaw cylinder 4, via a longitudinal shaft gearbox 1, various toothed steps 1.20, and a shaft 1.23 to an intermediate gear 1.3 coupled with a bevel gear 1.24 or, as an alternative, to the cutting cylinder 2 coupled with a bevel gear 1.24. The cylinders 2, 3 and 4 are mechanically coupled with one another via spur gears. It is disadvantageous here that the cylinders 2, 3 and 4 may assume any desired position in relation to one another and in relation to the longitudinal shaft 1.10 in the area of the backlash. This is due to the torques acting on the cylinders, such as cam controls, cutting shock, etc. Irregularities, which are not avoidable as a result, become noticeable in the folding tolerances.

SUMMARY AND OBJECTS OF THE INVENTION

The object of the present invention is therefore to provide a folder in which the setting of the register can be performed individually for the folder while at the same time preventing or at least reducing the backlash of the gears in the drive line of the folder. This is accomplished in a rotary printing press with at least one cutting cylinder and one folding jaw cylinder with a drive motor that is mechanically coupled with the folder and is only provided for the individual drive of the folder According to the present invention, a folder of a rotary printing press with at least one folding jaw cylinder and one cutting cylinder, has a drive motor, which is mechanically coupled with the folder only, for individually driving the folder. As a result, problems in terms of backlash must be counteracted in the area of the folder only, while the drive motor for the folder is electrically synchronized for driving the other components of the printing press. The individual drive makes it possible to rotate the folder from the position of the printing units to any desired folding position and thus to reach the crop mark in a simple manner. This advantage is especially useful in the case of paper in-feed into a back-up folder, because the crop mark can be reached in such a back-up folder via a null position of the drive, which is used as a reference. The folding tolerances are minimized by the present invention.

Due to no longer needing the mechanical coupling with the printing units, the free arrangement or mounting of the folder in relation to the printing units, and advantageously also in relation to a folding structure and a folding superstructure, is possible without causing any additional costs.

Since preferably there is no mechanical connection between the folder and the folding structure or the folding superstructure, flexibility is also increased with regard to the configuration of these three assembly units. It is possible, e.g., to assign only one structure and one superstructure to two folders.

In a preferred embodiment, a drive motor drives a folding jaw cylinder via a mechanical coupling, preferably a motor-side pinion and a cylinder-side spur gear. It is thus possible to obtain high transmission ratios in one step in a space-saving manner. The costs are reduced due to the elimination of a longitudinal shaft gearbox and all drive components, such as shafts and gears, including an intermediate gear. Due to its relatively high inertia of mass and low operating torques, the drive is coupled in this design variant at an especially quiet point of the folder. The pulling of the web at the collecting cylinder, the friction torques of the cylinder bearings, the draw rollers in the folder, and the cutting shock generate a torque, which counteracts the driving motor. A flank change by the control of the drive motor in the drive from the motor-side pinion to the cylinder-side spur gear and between the cylinder spur gears of the cylinders of the folder can be prevented from occurring as a result. Another advantage is the fact that due to the arrangement of the drive on the folding jaw cylinders and to the tooth contact being always on the same side, a change between driving and braking motor operation is prevented, and the motor runs in the driving range only. Such a change in operation could easily lead to damage to the drive of the folder. When pulsed operating torques occur, which may lead to disturbing flank changes in the drive, it is sufficient to always maintain the tooth contact especially between the pinion and the spur gear on the same side by an additional torque to the folding jaw cylinder. Such a torque is relatively small compared with the driving torque and can be introduced by, e.g., an electric brake or a friction brake.

In a likewise preferred embodiment, the motor-side pinion meshes with any other gear arranged downstream of the cutting cylinder in the drive line of the cylinders of the folder.

In another variant, the drive motor is arranged where the longitudinal shaft gearbox is located according to the state of the art.

In another preferred design variant, the drive motor drives the cutting cylinder via a toothed belt. The weight of the cutting cylinder can now be added to the low own weight of the drive motor, as a result of which the control dynamics can be improved. A transmission between the drive motor and the cutting cylinder in more than one stage may now also be provided.

Driving from the motor to the collecting cylinder via a toothed belt is also preferred. The weight of the collecting cylinder, which is greater than that of the cutting cylinder, can now also be added to the low own weight of the drive motor, which improves the control dynamics, as was mentioned above. A multistep transmission between the drive motor and the collecting cylinder may be preferred in this case as well.

Finally, the folding jaw cylinder may also be driven via such a toothed belt.

In another preferred embodiment of the present invention, the drive motor drives any desired gear in the entire drive line between the cutting cylinder and the delivery means, e.g., a spider wheel, via a toothed belt. It is also possible in this case to drive an intermediate gear that is in functional connection with the drive line. The necessary transmission ratio from the drive motor to the gear is advantageously achieved in one step, so that a space-saving solution is again obtained.

If a first folder and a second folder are provided, the following arrangement variants are preferred:

Both folders may be placed in the shop plane, especially as a left folder design and as a right folder design in a so-called back-to-back arrangement or as a double folder with delivery to the same side of the press. The first possibility can be built as an especially narrow unit with correspondingly short transfer paths for the web. The second variant, i.e., the double folder, offers the advantage that both delivery units are located on one side of the press and two identical folders can be used. Both arrangement variants make possible operation in one plane.

It is also possible to place a first folder in the shop plane, while a second folder is located, offset in relation to it, in the press cellar, i.e., in the reel changer plane. This leads to short web transfer paths and to unhindered access to the folders. If a folding structure and a folding superstructure are mounted on the press table, i.e., in the shop plane, a small overall height is obtained.

Finally, it is also possible to install both folders in the cellar, namely, as a double folder with separate structure mounted on the press table, or as a double folder in a common, attached structure and superstructure. Due to the arrangement in the reel changer plane or press cellar, both variants are characterized by a low overall height above the plane of the press. They can also be operated especially easily, because they are arranged in one plane.

Only one structure and one superstructure are advantageously provided for a plurality of folders in all the above-mentioned exemplary embodiments.

In another embodiment of the present invention, which can be advantageously combined with the above-mentioned exemplary embodiments, the folder itself is designed as a traveling folder. If the folding structure and the folding superstructure are placed on a yoke, a back-up folder, if one is provided, may be pushed in if needed instead of the main folder. Depending on the displacement method used, no additional space is needed now in the shop. If the press table itself is used as a yoke construction, and the folders are placed in the cellar, a small overall height is also achieved as a result.

The folding structure and the folding superstructure may, in principle, also be arranged as traveling units on a yoke construction.

The present invention can be especially advantageously combined with the drive and control design disclosed in EP 0 644 048 A2, whose teaching is thus included.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 1:
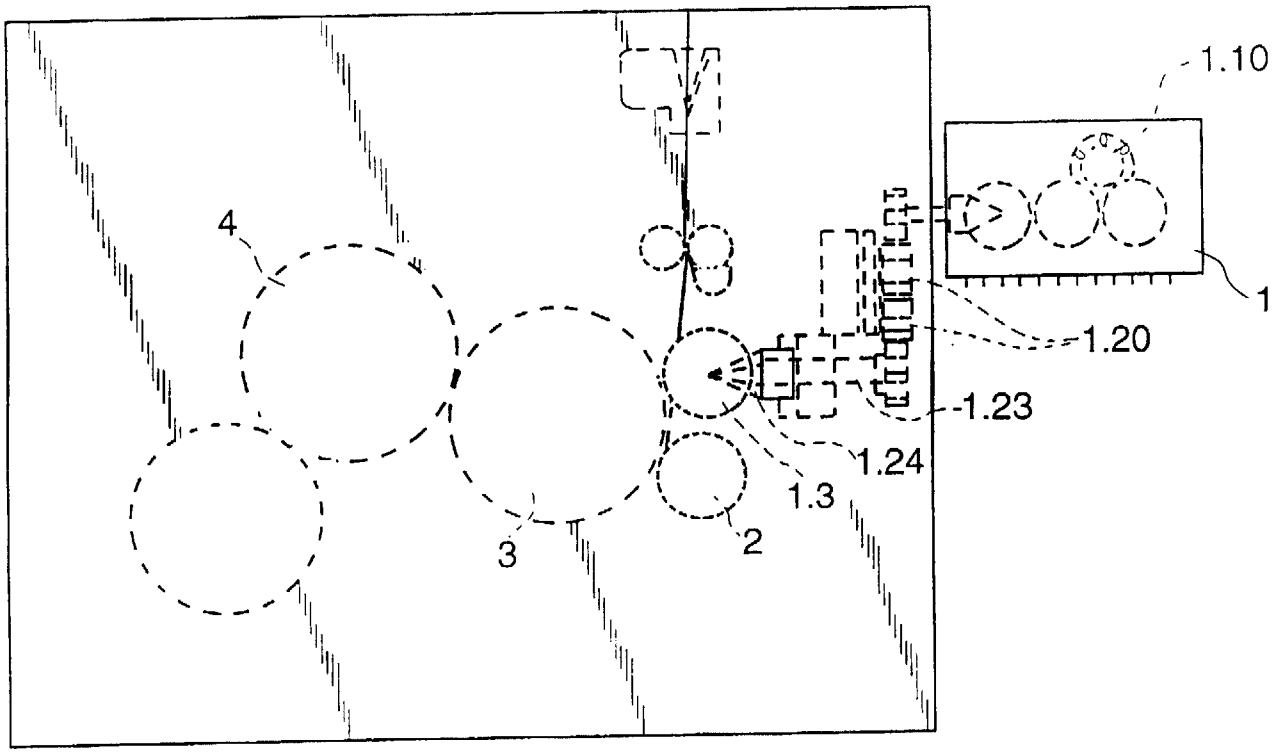
Fig. 1 (PRIOR ART)
FIG. 1 is an individually driven folder of the prior art.
Figure 2:
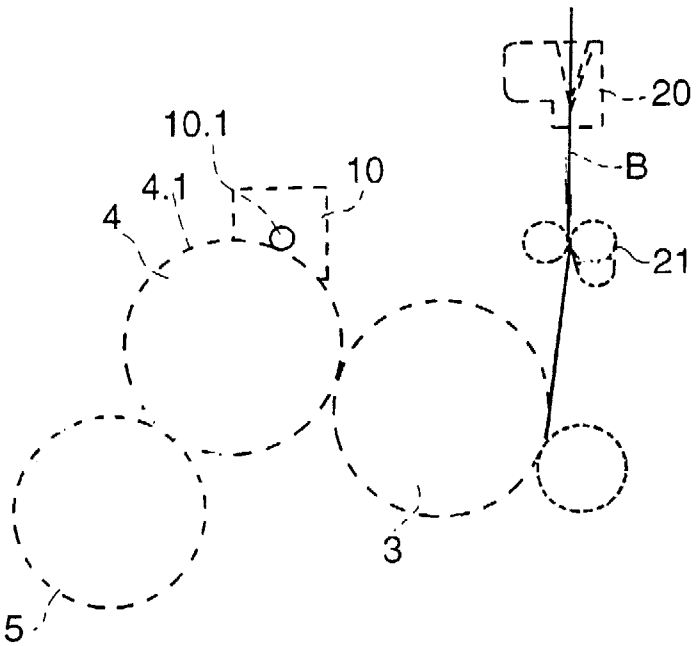
FIG. 2 is an individually driven folder of the present invention.

In FIG. 2, a printed web B runs through a web-severing device 20. A draw roller pair 21 is arranged behind the web-server device 20. The web then passes to a collecting cylinder 3 with a cutting cylinder 2. It is cut there transversely, and it is subsequently transferred from the collecting cylinder 3 to the folding jaw cylinder 4 and from there to a spider wheel S acting as a delivery means. It is also possible to provide a conveying means circulating endlessly between two rollers with grippers for the folded printed copies instead of the spider wheel 5.

In the exemplary embodiment shown, the folding jaw cylinder 4 is driven directly by a drive motor 10. The mechanical coupling between the drive motor 10 and the folding jaw cylinder 4 is formed via a motor-side pinion 10.1 and a cylinder-side spur gear 4.1.

Figure 3:
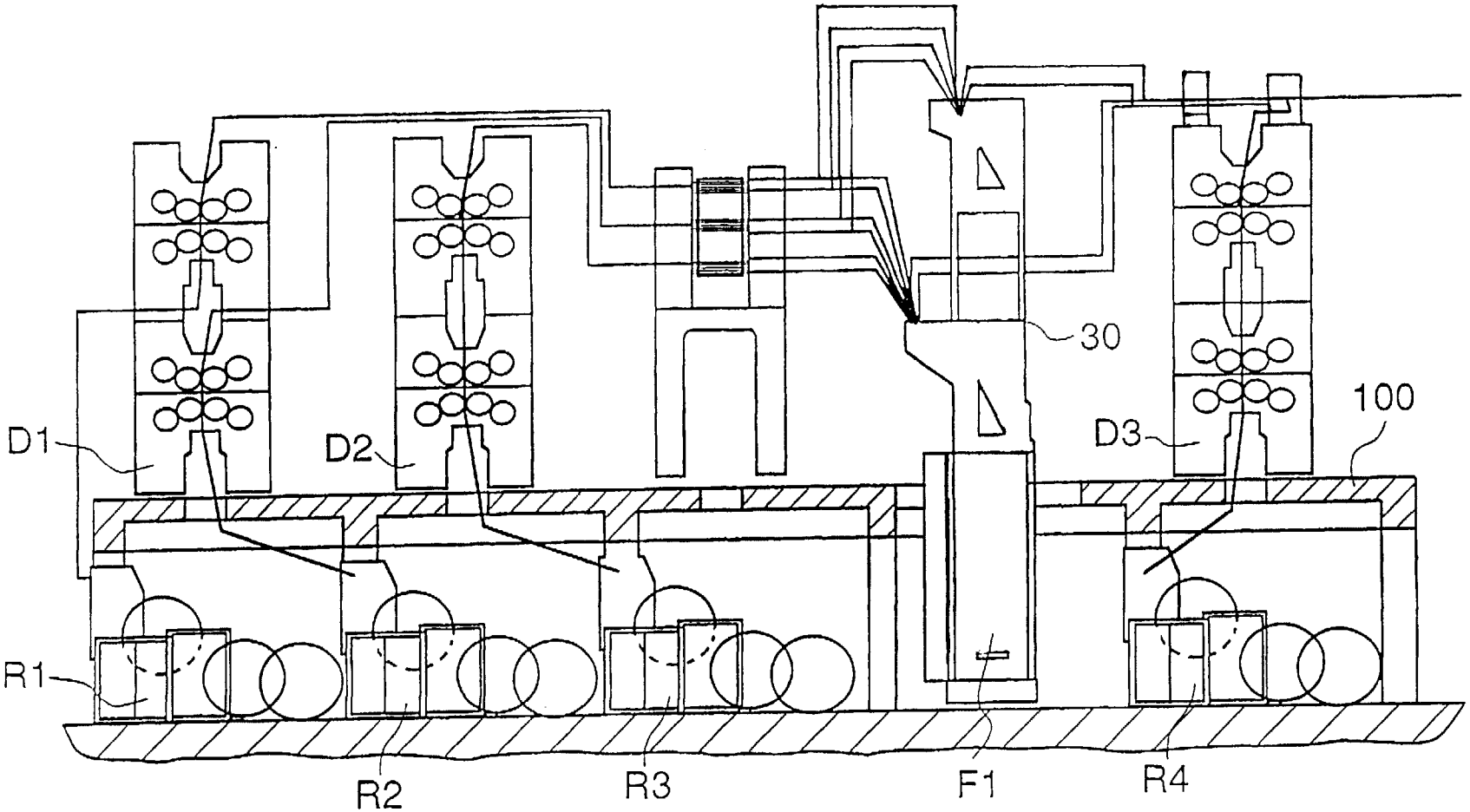
FIG. 3 is a first arrangement variant for two folders, wherein one folder is arranged in a press cellar.
Figure 4:
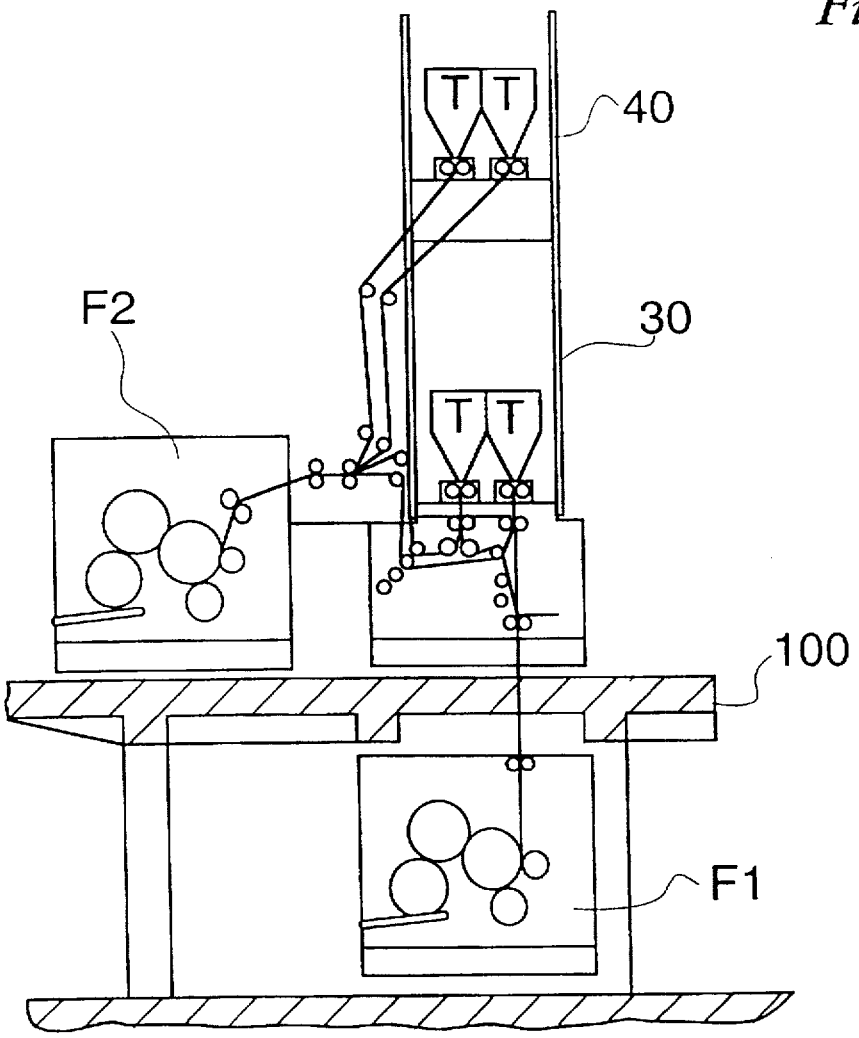
FIG. 4 is a more detailed representation of the arrangement variant according to FIG. 3.

FIG. 3 shows a printing press, which is an example of the gain in flexibility in terms of the possibilities for installation of the individually driven folders. In this exemplary embodiment, a folder unit F1 is installed in the press cellar in the same plane as the reel changers R1, R2, R3 and R4, while printing units D1, D2 and D3 are located in a superacent shop plane 100, aligned one behind the other. As shown in FIG. 4, a folding structure 30, which has at least one hopper in one or more planes, is arranged above the folder F1 and is mounted on the folder. The folding superstructure parts 30, 40 are arranged between the two printing units D2 and D3, so that the printed webs enter from two sides.

A second folder may be provided next to this first folder F1. The second folder is preferably also arranged in the reel changer plane, the press cellar, or in the shop plane 100, preferably approximately aligned with the lower folding superstructure 30.

The printed webs may be fed optionally to one of the folders. Only the folder F1 located in the press cellar is in operation in the example shown in FIG. 3. If two folders are provided, some of the printed webs conveyed farther behind the printing units may be fed to different hopper planes of the folding structure, which is indicated by broken lines as an example. The printed webs, folded lengthwise, then enter the second folder from the upper hopper plane of the folding structure 40, while the printed webs folded in the lower hopper plane 30 continue to be fed to the first folder F1.

FIG. 4 shows the arrangement of the second folder F2 in the shop plane 100. The first folder F1 is again placed in the press cellar, in the same plane as the reel changers, not shown in FIG. 4, while the second folder F2 is arranged next to the press, delivering to one side of the press. The folding superstructure 30 and 40 with one or more hopper planes is mounted on the press table.

Both the mounting and the drive of the folding superstructure 30 in the example according to FIG. 4 are mechanically independent from the drive and the mounting of the folders F1.

Figure 5:
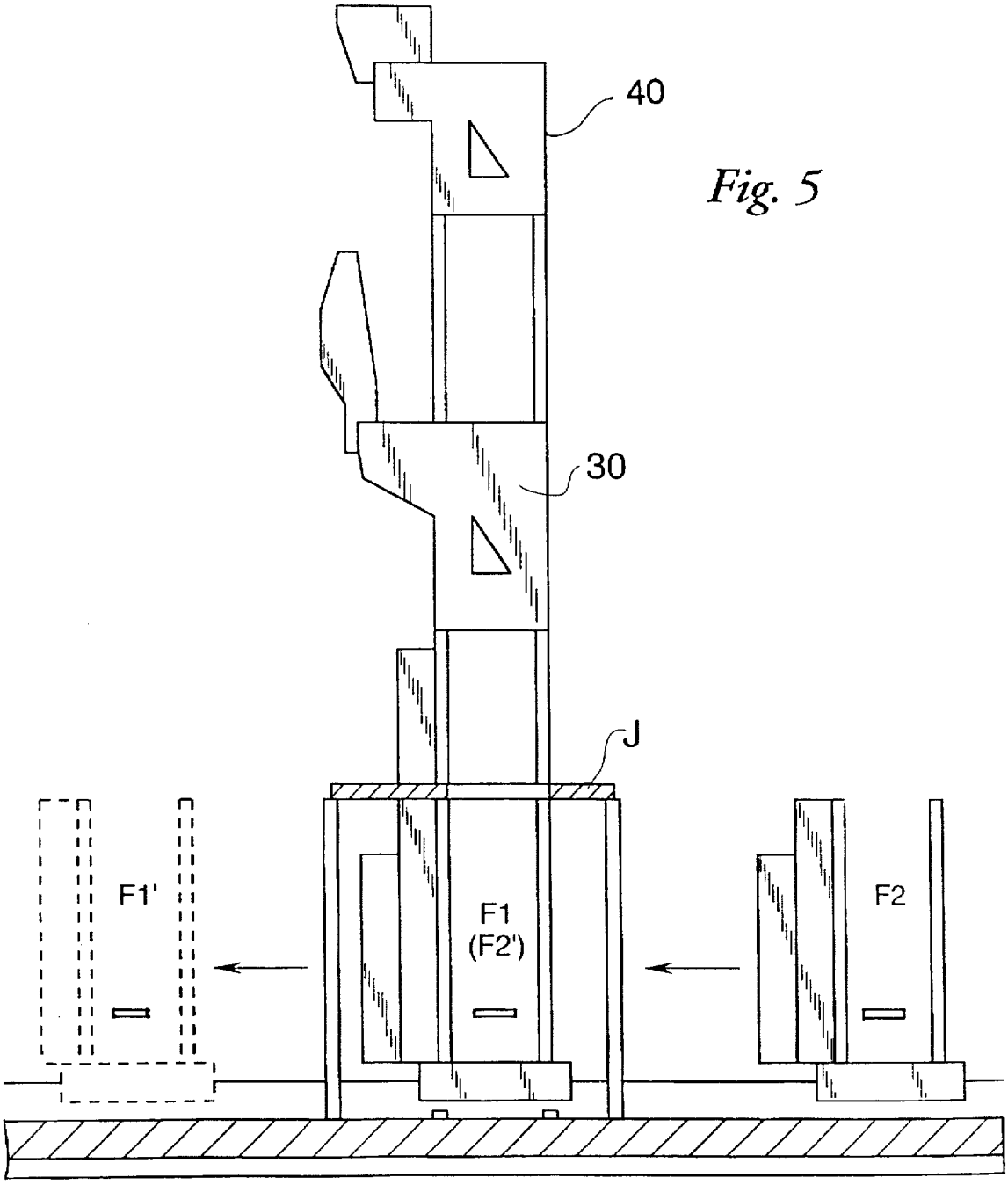
FIG. 5 is a second arrangement variant, in which a plurality of folders are arranged next to each other in the press cellar.

FIG. 5 shows two folders F1, F2 arranged in one plane, on the press table, in the plane of the reel changers, or in the press cellar. Only the first folder F1 is in operation, while the second folder is used as a back-up.

The printed web or webs is/are again fed to the folder F1 via a folding structure 30 mounted on a yoke J. The yoke J is mounted independently from the folders F1 and F2, which makes it possible to replace the first folder F1 with the back-up folder F2. The replacement of the folder F1 with the back-up folder F2 can be carried out in an especially simple manner if the two folders are traveling, or movable, folders (F1→g F1' and F2→F2').

Figure 6:
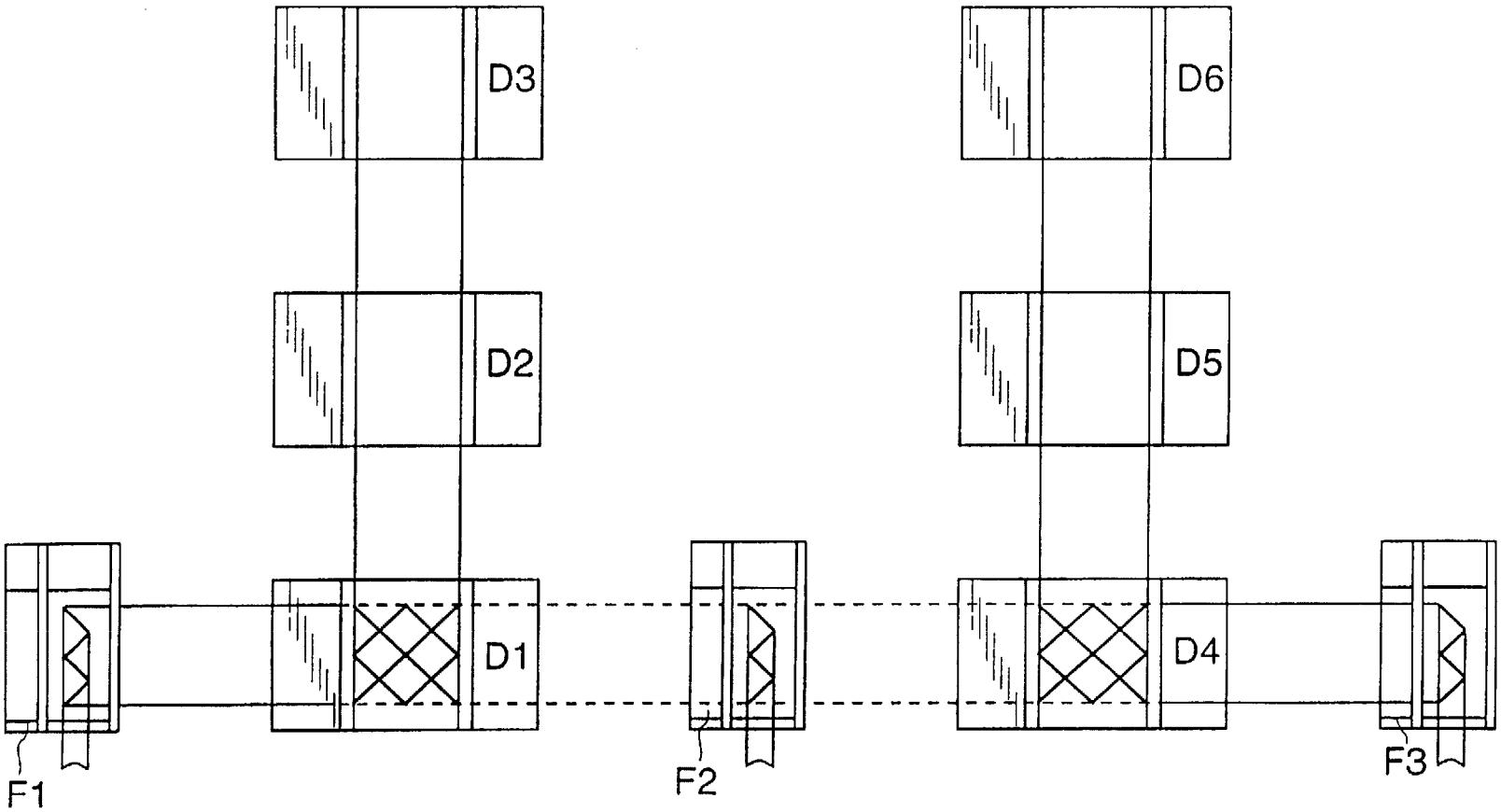
FIG. 6 is a third arrangement variant for a plurality of folders, which are arranged on one side each to the left and right of a printing unit.

FIG. 6 shows another example demonstrating the flexibility of the possible configurations of the printing press. The printing press has six printing units D1 through D6, of which three printing units each are arranged, when viewed in the direction of delivery of the web, one behind the other, and two such rows of three printing units each are mounted next to each other. Folders F1, F2 and F3 are placed to the left and right of the respective last printing unit D1 and D4 of the two rows of three printing units each such that one of the folders, F2, is arranged between the last two printing units D1 and D4, and so that printed webs can be fed from these two printing units to the centrally arranged folder F2, which is a common folder in this case. The other two folders F1, and 20 F3 are arranged on the still free outsides of each of the printing units D1 and D4.

An associated folding structure with a folding hopper, or folding hoppers, is located above each of the folders F1, F2 and F3, while the necessary deflecting rollers and turner bars for feeding in the printed webs are arranged above the last two printing units D1 and D4 standing next to the folders F1 and F3. The folded printed copies may be delivered uniformly in the longitudinal direction of the press. However, they may also be delivered to the sides in the case of the two outer folders F1 and F3, which again demonstrates the flexibility of the solution according to the present invention.

While specific embodiments of the invention have been shown and described in detail to illustrate the application of the principles of the invention, it will be understood that the invention may be embodied otherwise without departing from such principles.

What is claimed is:

1. A rotary printing press comprising:

a plurality of printing units;

a plurality of folder units associated with said plurality of printing units, each of said plurality of folder units including a cutting cylinder and a folding jaw cylinder;

a separate drive motor for each of said folder units said separate drive motor independently mechanically driving a respective said folder unit separately from said plurality of printing units, said each folder unit being registerable independently from said plurality of printing units.

2. A folder in accordance with claim 1, wherein:

said drive motor drives said folding jaw cylinder in said respective folder unit via a mechanical coupling.

3. A folder in accordance with claim 1, a wherein:

said drive motor drives said cutting cylinder in said respective folder unit via a mechanical coupling.

4. A folder in accordance with claim 1, further comprising:

a collecting cylinder associated with said cuffing cylinder and said folding jaw cylinder in said respective folder unit, said drive motor driving said collecting cylinder via a mechanical coupling.

5. A folder in accordance with claim 1, further comprising:

a delivery means associated with said cutting cylinder and said folding jaw cylinder in said respective folder unit, said drive motor driving a gear in a drive line between said cuffing cylinder and said delivery means.

6. A folder in accordance with claim 1, further comprising:

a collecting cylinder and a delivery means associated with said cutting cylinder and said folding jaw cylinder in said respective folder unit said drive motor driving said cutting cylinder, said collecting cylinder, said delivery means and said folding jaw cylinder by a mechanical coupling, said mechanical coupling including a pinion on said drive motor and a drive line connecting said cutting cylinder, said collecting cylinder, said delivery means and said folding jaw cylinder, said pinion driving one of an intermediate gear in said drive line and a gear directly connected to one of said cuffing cylinder, said collecting cylinder, said delivery means and said folding jaw cylinder.

7. A folder in accordance with claim 1, further comprising:

a collecting cylinder and a delivery means associated with said cutting cylinder and said folding jaw cylinder in said respective folder unit, said drive motor directly driving one of said cuffing cylinder, said collecting cylinder, said delivery means and said folding jaw cylinder.

8. A folder in accordance with claim 1, further comprising:

a delivery means associated with said cutting cylinder and said folding jaw cylinder in said respective folder unit, said drive motor driving said cutting cylinder, said delivery means and said folding jaw cylinder by a mechanical coupling, said mechanical coupling including a drive line connecting said cutting cylinder, said delivery means and a gear between said cutting cylinder and said delivery means, said drive motor being connected to said mechanical coupling by a toothed belt.

9. A rotary printing press in accordance with claim 1, wherein:

said plurality of folder units includes a first folder and a second folder, said first folder and said second folder are positioned in a shop plane and aligned one behind another in a longitudinal direction of said plurality of said printing units as a left folder design and as a right folder design in one of a back-to-back arrangement and on a same side of the printing press as a double folder.

10. A rotary printing press in accordance with claim 1, wherein:

said plurality of folder units includes a first folder and a second folder, said first folder is positioned in a shop plane, and said second folder is positioned in a reel changer plane which is vertically offset from said first folder.

11. A rotary printing press in accordance with claim 1, wherein:

a plurality of reel changers are positioned in a reel changer plane;

said plurality of folder units includes a first folder and a second folder, said first folder and said second folder are positioned in said reel changer plane.

12. A rotary printing press in accordance with claim 1, wherein:

a said each-of said plurality of folder units are designed to be repetitively movable with respect to said plurality of printing units.

13. A rotary printing press in accordance with claim 1, further comprising:

a folding structure associated with said plurality of printing units and folder units, said folding structure being driven mechanically independently from said plurality of printing units and said plurality of folder units.

14. A rotary printing press in accordance with claim 1, further comprising:

a folding structure associated with said plurality of printing units and folder units, said folding structure being mounted independently and upstream of said folder units, said folding structure being mounted in one of a plane of the press and above the plane of the press.

15. A rotary printing press in accordance with claim 1, further comprising:

a folding structure associated with said plurality of printing units and folder units, said folding structure being mounted independently of said folder units on a yoke, said folding structure being mounted in one of a plane of the press and above the plane of the press.

16. A rotary printing press in accordance with claim 15 wherein:

said folding structure operates with more than one of said plurality of folder units.

17. A rotary printing press in accordance with claim 1, wherein:

a first set of said printing units are arranged one behind another in a direction of delivery of a respective web;

a second set of said printing units are arranged one behind another in a direction of delivery of a respective web, said second set of printing units being mounted next to said first set of printing units;

said plurality of folders are positioned laterally to an end printing unit of each of said first and second sets of printing units, said plurality of folders including one folder positioned between said first and second sets of printing units, and said plurality of folders including other folders positioned on opposite outside positions of said end printing units of said first and second sets of printing units.

18. A rotary printing press in accordance with claim 1, wherein:

said plurality of folder units are movable separately from said plurality of printing units.

* * * * *

US005775222B1

(12) REEXAMINATION CERTIFICATE (4493rd)

United States Patent

Zweifel et al.

(10) Number: US 5,775,222 C1

(45) Certificate Issued: Nov. 27, 2001

(54) INDIVIDUALLY DRIVEN FOLDER FOR A ROTARY PRINTING PRESS

(75) Inventors: Johann Zweifel, Boll; Thomas Treuthardt, Wohlen, both of (CH)

(73) Assignee: Maschinenfabrik WIFAG, Bern (CH)

Reexamination Request:
No. 90/005,195, Dec. 16, 1998

Reexamination Certificate for:

| | |
|---|---|
| Patent No.: | **5,775,222** |
| Issued: | **Jul. 7, 1998** |
| Appl. No.: | **08/647,467** |
| Filed: | **May 3, 1996** |

(30) Foreign Application Priority Data

May 4, 1995 (DE) ..... 195 16 443

(51) Int. Cl.[7] ..... B41F 13/56; B41F 13/58

(52) U.S. Cl. ..... 101/227; 270/6; 270/8

(58) Field of Search ..... 101/226, 227, 101/228; 270/4, 6, 8, 20.1, 21.1, 43, 52.09; 493/357, 359, 424, 425, 426, 427, 428, 429, 431, 477, 478

(56) References Cited

U.S. PATENT DOCUMENTS

| | | | | |
|---|---|---|---|---|
| 664,589 | | 12/1900 | Scott . | |
| 2,022,696 | | 12/1935 | Tomlin . | |
| 2,613,077 | | 10/1952 | Smith, Jr. . | |
| 2,941,798 | * | 6/1960 | Harless | 493/429 |
| 3,702,186 | | 11/1972 | Dichinsky . | |
| 3,784,187 | * | 1/1974 | Takayanagi et al. | 493/359 |
| 4,538,517 | | 9/1985 | Michalik . | |
| 4,861,326 | * | 8/1989 | Kültner et al. | 101/226 |
| 5,117,753 | | 6/1992 | Mamberger . | |
| 5,405,127 | | 4/1995 | Welborn . | |
| 5,542,350 | * | 8/1996 | Theilacker et al. | 101/228 |

FOREIGN PATENT DOCUMENTS

| | | |
|---|---|---|
| 1919695 | 11/1970 | (DE) . |
| 2046131 | 3/1972 | (DE) . |
| 2435972 | 2/1976 | (DE) . |
| 26 14 665 | 10/1976 | (DE) . |
| 408051 | 6/1992 | (DE) . |
| 41 27 321 A1 | 2/1993 | (DE) . |
| 520967 | 12/1992 | (EP) . |
| 0 531 668 | 3/1993 | (EP) . |
| 0 567 741 A1 | 11/1993 | (EP) . |
| 581179 | 2/1994 | (EP) . |
| 0 699 524 | 3/1996 | (EP) . |
| 1 490 675 | 11/1977 | (GB) . |
| 2 149 149 A | 6/1985 | (GB) . |

OTHER PUBLICATIONS

"Newspaper Techniques", Dec. 1991 pp. 68–70.
"Newspaper Techniques", Jan. 1994 pp. 66–70.
"Deutscher Drucker", Apr. 13, 1995, pp. 52, 53.
"Pressman's Manual 259", Rockwell International Oct. 1978, pp. 1,2,37.
"Former–Superstructures and Combined "Former–Angle Bars"—Superstructures Albert Gravure Rotaries", Albert Frankenthal, Apr. 1986.
"Magazine Super–Structure, "Rapid" System Albert Gravure Rotaries", Albert Frankenthal Apr. 1986.
"Press Configurations Albert Gravure Rotaries", Albert Frankenthal Apr. 1986.

* cited by examiner

*Primary Examiner*—Eugene H. Eickholt

(57) ABSTRACT

A rotary printing press comprising a plurality of folder units including a cutting cylinder and a folding jaw cylinder with each of the folder units having a separate drive motor mechanially driving each folder unit separately from the plurality of printing units with each folder unit registerable independently from the plurality of printing units.

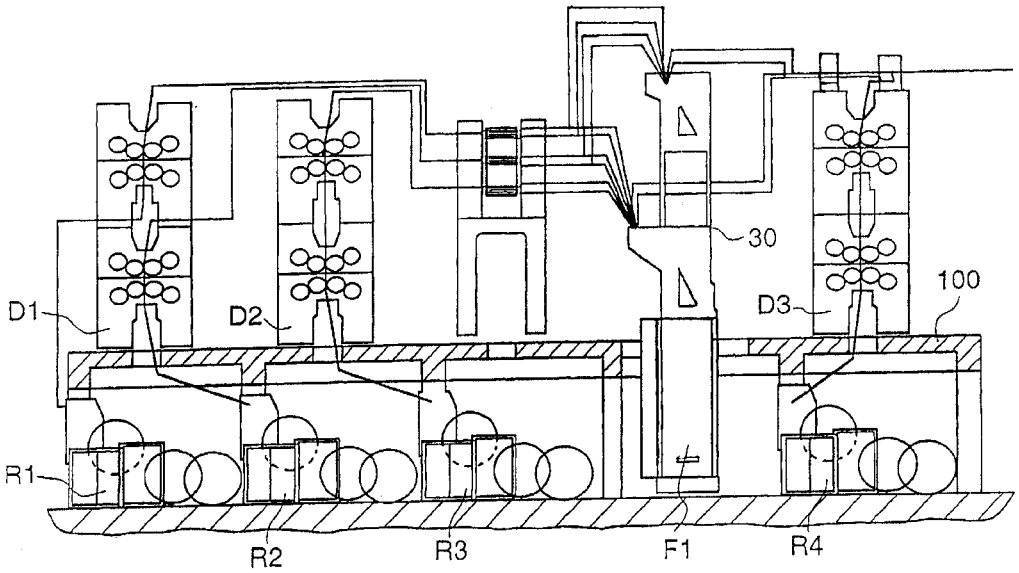

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 2 and 4–8 are cancelled.

Claims 1, 3 and 12 are determined to be patentable as amended.

Claims 9–11 and 13–18, dependent on an amended claim, are determined to be patentable.

New claims 19–26 are added and determined to be patentable.

1. A rotary printing press comprising:

a plurality of printing units;

a plurality of folder units associated with said plurality of printing units, each of said plurality of folder units including a cutting cylinder and a folding jaw cylinder;

a separate drive motor for each of said folder units, said separate drive motor independently mechanically driving a respective said folder unit separately from said plurality of printing units, *each said drive motor directly driving a respective said folding jaw cylinder of a respective said folder unit through a mechanical coupling, each said mechanical coupling including one of a toothed belt, and a drive pinion connected to a respective said drive motor with a spur gear seated on a respective said folding jaw cylinder,* said each folder unit being registerable independently from said plurality of printing units*;*

*a collecting cylinder and a delivery means associated with said cutting cylinder and said folding jaw cylinder in said respective folder unit, said drive motor driving said cutting cylinder, said collecting cylinder, said delivery means and said folding jaw cylinder by said mechanical coupling, said mechanical coupling including a drive line connecting said cutting cylinder, said collecting cylinder, said delivery means and said folding jaw cylinder, said drive pinion driving one of an intermediate gear in said drive line and a gear directly connected to one of said cutting cylinder, said collecting cylinder, and said delivery means.*

3. A folder in accordance with claim 1, [a] wherein:

said drive motor drives said cutting cylinder in said respective folder unit [via a mechanical coupling].

12. A rotary printing press in accordance with claim 1, wherein:

[a] said each-of said plurality of folder units are designed to be repetitively movable with respect to said pluarlity of printing units.

*19. A rotary printing press arrangement comprising:*

*a plurality of printing units;*

*a plurality of folder units associated with said plurality of printing units;*

*a cutting cylinder in each of said folder units;*

*a folding jaw cylinder in each of said folder units and cooperating with a respective said cutting cylinder;*

*a separate drive motor in each of said folder units and independently directly driving a respective said folding jaw cylinder through a mechanical coupling, said mechanical coupling including one of a toothed belt, and a drive pinion connected to said drive motor with a spur gear seated on said folding jaw cylinder, said each folder unit being registerable independently from said plurality of printing units.*

*20. The rotary printing press arrangement in accordance with claim 19, wherein:*

*at least one drive motor drives each of the folder units with said toothed belt.*

*21. The rotary printing press arrangement in accordance with claim 19, wherein:*

*said plurality of printing units are arranged in a longitudinal direction;*

*one of said folder units and another of folder units are positioned in a feeding plane of the rotary printing press arrangement and aligned one behind another in a longitudinal direction of said plurality of said printing units as a left folder design and as a right folder design in one of a back-to-back arrangement and on a same side of the printing press as a double folder.*

*22. The rotary printing press arrangement in accordance with claim 19, further comprising:*

*one of said folder units is arranged in a feeding plane of the rotary printing press arrangement and vertically offset with respect to another of said folder units which is arranged in a roll change plane of the rotary printing press arrangement.*

*23. The rotary printing press arrangement in accordance with claim 19, further comprising:*

*one of said folder units and another of said folder units are arranged in a roll change plane of the rotary printing press arrangement.*

*24. The rotary printing press arrangement in accordance with claim 19, wherein:*

*one of said folder units is displaceable in the rotary printing press arrangement.*

*25. The rotary printing press arrangement in accordance with claim 19, further comprising:*

*a folder superstructure mounted independently of said folder and in one of a plane of the rotary printing press arrangement, and elevated on a yoke.*

*26. The rotary printing press arrangement in accordance with claim 19, wherein:*

*said mechanical coupling includes said drive pinion directly connected to said drive motor and in direct tooth contact with said spur gear directly connected to said folding jaw cylinder.*

* * * * *